US006945846B1

(12) United States Patent
Petroski et al.

(10) Patent No.: US 6,945,846 B1
(45) Date of Patent: Sep. 20, 2005

(54) POLISHING PAD FOR USE IN CHEMICAL/MECHANICAL PLANARIZATION OF SEMICONDUCTOR WAFERS HAVING A TRANSPARENT WINDOW FOR END-POINT DETERMINATION AND METHOD OF MAKING

(75) Inventors: Angela Petroski, Crawfordsville, IN (US); Richard D. Copper, Sullivan, IN (US); Paul Fathauer, Sullivan, IN (US); David Perry, Crawfordsville, IN (US)

(73) Assignee: Raytech Innovative Solutions LLC, Crawfordsville, IN (US)

( * ) Notice: Subject to any disclaimer, the term of this patent is extended or adjusted under 35 U.S.C. 154(b) by 0 days.

(21) Appl. No.: 11/091,965

(22) Filed: Mar. 28, 2005

Related U.S. Application Data

(60) Division of application No. 10/390,555, filed on Mar. 17, 2003, now Pat. No. 6,875,077, which is a continuation-in-part of application No. 10/349,201, filed on Jan. 22, 2003, now Pat. No. 6,852,020.

(60) Provisional application No. 60/365,100, filed on Mar. 18, 2002.

(51) Int. Cl.[7] ..... B24B 1/00

(52) U.S. Cl. ..... 451/6; 451/37; 451/56; 451/58; 451/526; 51/298

(58) Field of Search ..... 451/6, 36, 37, 451/41, 490, 285–290, 526–529; 438/5, 7, 438/8, 691–693; 156/345.11, 345.12, 345.13, 156/345.14

(56) References Cited

U.S. PATENT DOCUMENTS

| | | | | |
|---|---|---|---|---|
| 5,304,223 | A * | 4/1994 | Pieper et al. | 51/293 |
| 5,435,816 | A * | 7/1995 | Spurgeon et al. | 51/295 |
| 6,022,264 | A * | 2/2000 | Cook et al. | 451/37 |
| 6,299,516 | B1 * | 10/2001 | Tolles | 451/287 |
| 6,300,247 | B2 * | 10/2001 | Prabhu | 438/691 |

* cited by examiner

*Primary Examiner*—Joseph J. Hail, III
*Assistant Examiner*—Anthony Ojini
(74) *Attorney, Agent, or Firm*—Much Shelist; Milton S. Gerstein

(57) ABSTRACT

A porous polishing pad for use chemical/mechanical planarization of semiconductor wafers is provided with a transparent section formed in a section of the porous polishing pad by direct injection of a polymeric material into a modified portion of the pad. The modified section may be either a low density area, or may be created by removing a complete vertical section of the pad. The injected polymer forms an integral window with the pad by flowing into the matrix of the pad at the pad/window interface. No additional reinforcement is required to hold the window in place; however, adhesive and/or another impervious layer may be attached behind the window for additional support. In an alternative embodiment, a separate and distinct window-plug is inserted into a cutout section of the pad, and bonded to the pad by one or more binding film layers on the back, non-working surface of the pad.

9 Claims, 4 Drawing Sheets

POLISHING PAD FOR USE IN CHEMICAL/MECHANICAL PLANARIZATION OF SEMICONDUCTOR WAFERS HAVING A TRANSPARENT WINDOW FOR END-POINT DETERMINATION AND METHOD OF MAKING

CROSS REFERENCE TO RELATED APPLICATIONS

Priority of provisional application No. 60/365,100 filed on Mar. 18, 2002 is herewith claimed. The present application is, also, a division of Ser. No. 10/390,555, filed Mar. 17, 2003, now U.S. Pat. No. 6,875,077, which is a continuation-in-part of U.S. patent, application Ser. No. 10/349,201, filed on Jan. 22, 2003 now U.S. Pat. No. 6,852,020.

BACKGROUND OF INVENTION

The present invention is related to polishing of materials, in particular to the chemical mechanical polishing (CMP) of integrated circuits. Specifically, a method for placing a transparent section in a polishing pad is described. In particular, the present invention is directed to forming or placing an end-point detecting, laser-transparent window in a CMP polishing pad disclosed in above-mentioned parent application Ser. No. 10/349,201, or the porous polishing pad disclosed in commonly-owned U.S. patent application No. 10/087,223, filed on Mar. 1, 2002, which applications are incorporated by reference herein. The CMP porous polishing pads disclosed therein are made of a matrix of porous paper-making fibers that is impregnated and bound together with a thermoset resin. Such a polishing pad is a matrix of absorbent cellulose fibers, for example, and are impregnated with a thermoset resin, preferably phenolic, is densified, and cured to provide a rigid, yet porous structure. The porous CMP polishing pads thereof are made by a wet-laid, specialty paper-making process.

In the field of semiconductor manufacture, numerous integrated circuits are produced on wafers through layers of wiring devices. During the process of forming layers and structures, the topography of the surface becomes increasingly irregular. The prevailing technology for planarizing the surface is chemical mechanical polishing (CMP). In effect, this process polishes the top layer of an integrated circuit prior to the depositing of another layer.

In most chemical-mechanical polishing, the working layer of an integrated circuit is exposed to a moving polishing pad and a chemical slurry solution. In some systems, the polishing pad, mounted on a platen, rotates about a fixed axis, while the wafer rotates and moves across the pad. Since material on the active layer is removed during the process, it is critical that the polishing process be terminated at the correct time. In order to control the end point of the polishing process, various methods have been developed. The most prevalent method has utilized laser interferometry which detects the end point of the polishing process, an example of which is disclosed in U.S. Pat. No. 6,280,289. —Wiswesser, et al. In these systems, a laser is mounted in the platen and directed through the pad onto the surface of the wafer. A control system detects changes in the reflected signal to determine the end point.

In order for end-point detection to be carried out, the pad must have a section that is reasonably transparent to the wavelength of the laser being used. Most methods for producing a transparent region in the polishing pad involve inserting a formed, transparent plug into a hole in the pad. The plug is usually secured to the pad by an adhesive film onto the back, or rear, non-working side or surface of the polishing pad.

SUMMARY OF THE INVENTION

It is, therefore, the primary objective of the present invention to provide an end-point-detecting, laser-transparent window in a porous CMP polishing pad, and, in particular, for providing such a window in a porous polishing pad made of a fibrous matrix of paper-making fibers manufactured by a specialty, paper-making process and bonded by a thermoset resin.

According to present invention, a porous, wet-laid-manufactured polishing pad made of paper-making fibers bound by a thermoset resin is formed with a local transparent section. Transparency for purposes of the present invention is defined as sufficient light transmission such that the end-point detection system is able to function. Such a local transparent section is formed within the pad by either removing a section of the pad itself, or by creating allow density area in the paper-making fiber matrix. In either case, the pad is fixtured, or grasped, between two flat plates creating a mold with the local section. The local section is filled with a polymeric material that is injected under pressure into the region. The polymer may be a cured polymer that is heated to permit flow, or may be an uncured polymer that is mixed prior to injection into the local portion of the porous polishing pad. In either case, the polymer is subjected to pressure to permit flow. As the injected material flows into the matrix of the pad, a diffusion zone around the perimeter of the window is created, whereby the polymeric material bonds securely with the pad. The resulting region thereby is transparent to the laser emanating from the end-point detection system.

The types of materials suitable for the window include amorphous, semi-crystalline, crystalline or elastomeric polymers. Generally, polymers that exhibit low shrinkage and maintain clarity upon cooling, such as amorphous polymers, are the preferred choice.

A method for creating a transparent section of the invention in the polishing pad consists of partially or completely removing a section of the polishing pad, or creating a low density area in the desired region of the pad; forming a mold in the region by placing the pad between two flat surfaces; injecting the polymer in a liquid or semisolid state into the region; and allowing the assembly to cool and/or cure.

In a different embodiment, a separately-formed, stepped window-plug is inserted into the cutout or opening formed on the polishing pad, and retained therein by a first impervious layer, and a second adhesive layer.

BRIEF DESCRIPTION OF THE INVENTION

The invention will be more readily understood with reference to the accompanying drawings, wherein.

Figure 2:
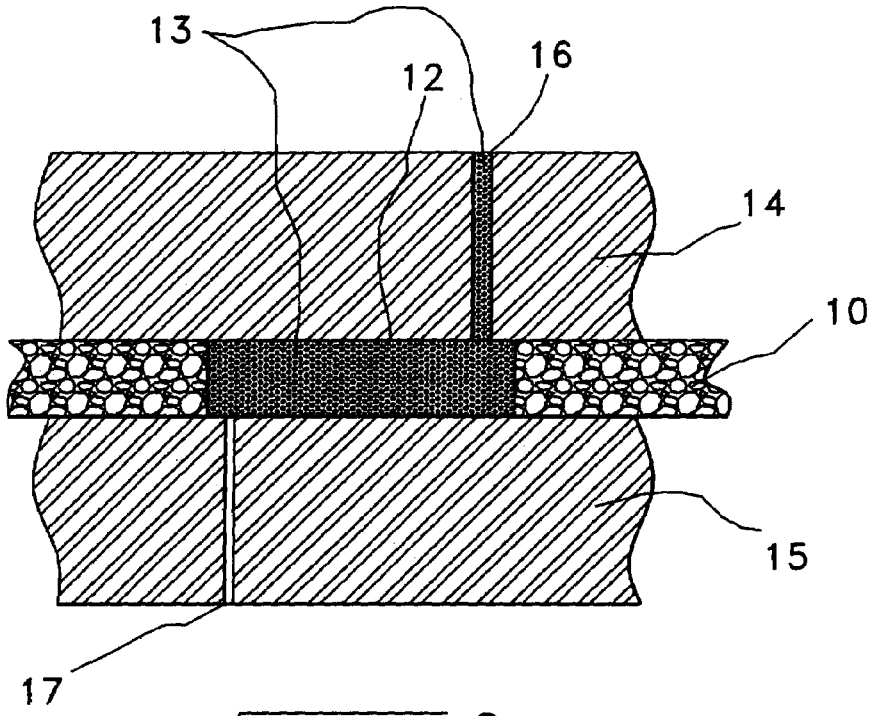
FIG. 2 is a side-elevational view, in cross-section, showing the fixing plates for holding the polishing pad of FIGS.
Figure 4:
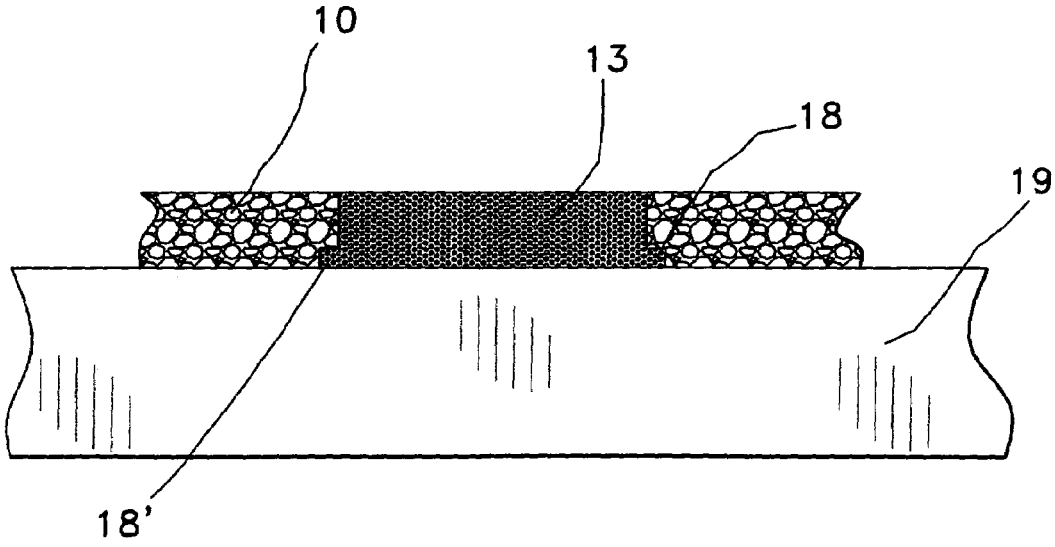
Figure 3A:
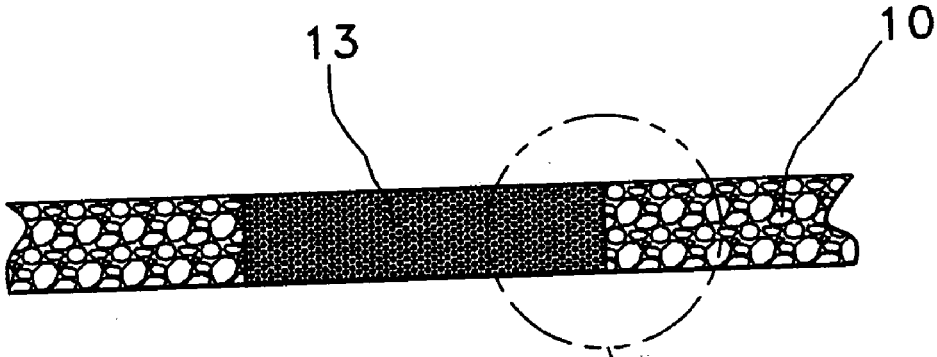
Figure 3B:
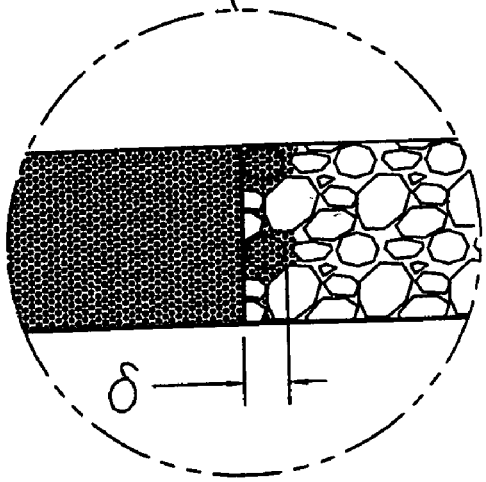
Figure 5:
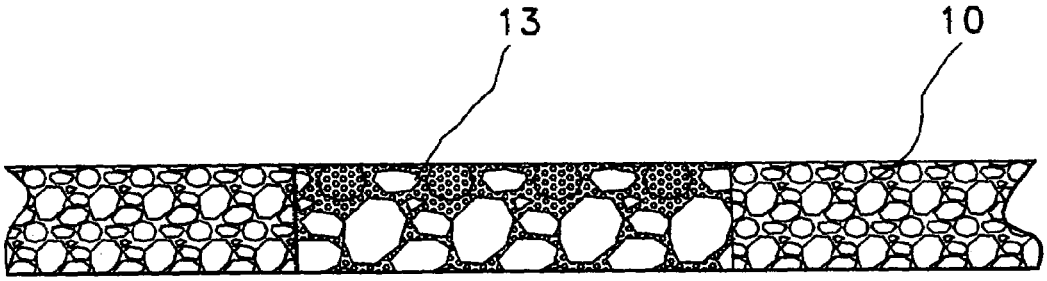
Figure 6:
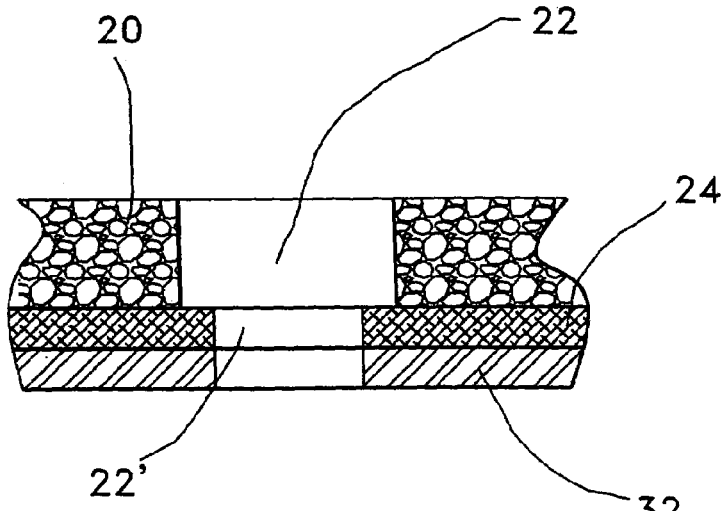

1A and 1B for injection of a polymer into the local area or region for forming the window of the present invention in the polishing pad;

FIG. 3A is a longitudinal cross-sectional view of the finished polishing pad with window section of the present invention, which window section is transparent to the laser beam emanating from end-point determination equipment used during chemical-mechanical planarization of wafers;

FIG. 3B is detailed view of the polishing pad of FIG. 3B showing the interface between the window made during the process shown in FIG. 2 with the remainder of the porous polishing pad;

FIG. 4 is a cross-sectional view of a modification of the polishing pad with transparent window section of FIGS. 3A and 3B, which window section is provided with a stepped, or larger-diameter lower section for contact against retaining platen of a chemical-mechanical polishing apparatus, for ensuring greater retention of the polymeric window section;

FIG. 5 is a cross-sectional of a second embodiment of the polishing pad with transparent window section of the invention, where, instead of a local section being cutout, an area of lower density from the rest of the polishing pad is used for forming the transparent window section; and FIG. 6 is a cross-sectional view of a third embodiment of the polishing pad with transparent window section of the invention, where an independently-molded and inserted transparent window-plug is used for forming the transparent window section.

DETAILED DESCRIPTION OF THE INVENTION

Figure 1A:
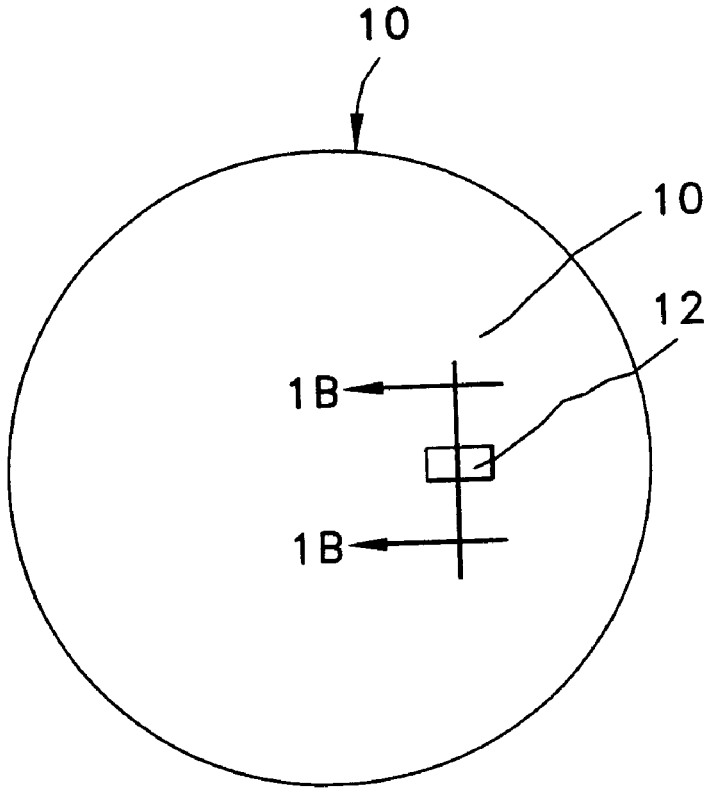
FIG. 1A is a plan view of the polishing pad for chemical-mechanical planarization of wafers of the invention incorporating the laser-transparent window of the invention.
Figure 1B:
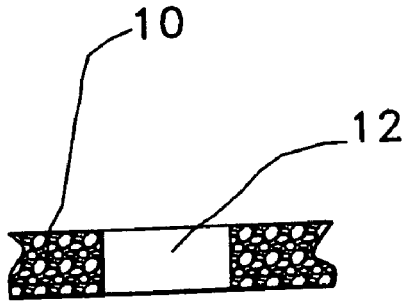
FIG. 1B is detailed cross-sectional view taken along line A—A of FIG. 1A showing the local area or region at which the transparent window of the invention is to be formed.

Referring now to the drawings in greater detail, FIGS. 1A and 1B show a polishing pad 10 which has a local region or area 12 where the pad material has been removed. The preferred polishing pad that is used in the present invention is one that is disclosed in commonly-owned U.S. patent application Ser. No. 10/087,223, filed on Mar. 1, 2002, and parent application Ser. No. 10/349,201, filed on Jan. 22, 2003, which are incorporated by reference herein. These porous polishing pads are made of a specialty-paper-making matrix of a porous paper-making fiber-structure that is impregnated and bound together with a thermoset resin. Such a polishing pad is a matrix of absorbent paper-making fibers impregnated with a thermoset resin, preferably phenolic, is densified, and cured to provide a rigid, yet porous structure, and preferably made by a paper-making, wet-laid process. The preferred method of production is wet laid, since this process lends itself most readily to the incorporation of various fibers, fillers and chemicals. However, it is understood that other processes that produce a similar porous, fibrous structure may also be used. These processes may include dry laid processes, such as spun bond, melt blown, felting, carding, weaving, needlepunch and others. The preferred fiber for producing the wet laid, fibrous structure of the polishing pad used in the present invention is cellulose fiber, and, in particular, cotton linters and lyocell fibers. Other paper-making fibers that may be used are cotton, other cellulose fibers such as wood pulp, glass, linen, aramid, polyester, polymer, carbon, polyamide, rayon, polyurethane, phenolic, acrylic, wool, and any natural or synthetic fiber or blends thereof. The polishing pad used in the present may incorporate nanometer-sized abrasive particles, as disclosed in parent application Ser. No. 10/349,201, or may be a polishing pad without such nanometer-sized abrasive-particles as disclosed in above-mentioned application Ser. No. 10/087,223. It is, of course, to be understood that the present invention may also be used with other polishing pads formed of a porous matrix-structure.

In order to form a window that is transparent to the laser beam, or equivalent light beam, of a conventional end-point detection system (not shown) associated with a CMP apparatus, which window is preferably rectangular in shape, the pad 10 is placed in a fixture, or mold, consisting of two flat plates 14, 15 that may be heated, or may not be heated, as shown in FIG. 2. The plates 14, 15 may cover the entire pad 10, or cover only the local area 12. Polymer 13, which is either heated to a temperature that causes a flowing state thereof, or is treated exothermically to cause such flowing state in a well-known manner, is injected through an injection gate 16, while the atmosphere in the formed cavity is removed through a vent 17. Once the cavity is completely filled with the polymer, the polymer is cooled at a controlled rate in order to prevent excessive shrinkage of the window, and in order to maintain the clarity of the polymer. Once the pad has been removed from the mold-fixture, further treatment of the window, if required, may be performed in order to remove any irregularities formed via the injection gate 16 and vent 17. The mold-fixture preferably removes any irregularities during the injection process by closing the gate and vent holes at a specific time, thereby making the polymer planar with the cavity. Vent 17 may not be required for a more porous pad, where the atmosphere in the cavity is able to evacuate through the material of the polishing pad itself. The polymer may be amorphous, semi-crystalline, crystalline or elastomeric material. Laser-transparent polymers that may be used, but not limited to, are clear: Polypropylene (PP), acrylonitrile-butadiene-styrene (ABS), polycarbonate (PC), acrylic-styrene-acrylonitrile (ASA), polyphenylene ether (PPE), and polyetherimide (PEI).

The integrity of the window of the polishing pad is formed by diffusion of the flowing polymer into the porous pad. FIGS. 3A and 3B show the completed polishing pad-assembly, and the diffusion zone at the pad-material/window interface. The depth of the diffusion "d" is dependent on the temperature of the pad matrix during the injection process, the porous nature of the pad, and the viscosity of the polymer or polymers used. In the case where the polymer is heated, the diffusion depth "d" is greater when the matrix of the pad at the interface is held at or above the melting point or above the softening point of the polymer. Also, the depth is also function of the interconnecting nature of the pad matrix, the pore size thereof, and the molecular weight of the polymer. Modifying the density of the pad-material around the window also controls the penetration of the polymer into the pad-matrix. By creating a lower density zone around the window, the diffusion is increased. By creating a higher density zone around the window, the diffusion zone is decreased, and may be eliminated at a high-density barrier. Further structural integrity may be achieved by attaching an adhesive layer, other impervious layer, or both, to the back, or rear, of the window and pad-matrix, in a manner similar to that described hereinbelow with respect to the embodiment of FIG. 6. These layers may be polymer adhesive films, or other films, that are attached to the back side of the pad with heat, or applied in an uncured liquid state and allowed to cure. In either case, the additional layer or layers of sufficient clarity and transparency to allow for the proper functioning of CMP end-point detection. In some cases, an area in the adhesive layer or impervious layer may be completely removed that is slightly smaller than the area of the transparent region in the pad, in order to ensure such laser-transparency. In such a case, the adhesive layer or impervious layer forms a circumferential shoulder about the bottom perimeter of the transparent region, allowing for increased integrity of the window, in a manner depicted in FIG. 6, and described hereinbelow. The adhesive layer may be used to secure or affix the pad to a platen of a CMP apparatus in a well-known manner.

According to the invention, the window formed in the polishing pad preferably has an approximate opacity range of 0–70% (30–100% transmission) for a laser of a wavelength in the range 150–3500 nm. Most laser systems for end-point detection are approximately in the range of 600–700 nm.

Referring to FIG. 4, there is shown a modification of the polishing pad with window of the invention, which window is stepped. The local region or area 13 for the window is formed with a shoulder, or larger-diameter, circumferential cutout section 18 on the non-working side thereof. As before, the cavity is injected with flowing polymer, by which a stepped window is formed with a larger cross-sectional area 18' adjacent the rear, non-working surface of the polishing pad. The major advantage with this modification is the increased integrity of the window. In particular, since the enlarged section 18' of the window section 18 at the base of the window is supported by the platen 19 during operation in a chemical-mechanical planarization apparatus, there is decreased tendency for the polymer forming the window to be ejected or to fall out during polishing. This modification is more advantageous for pad and/or window materials where an acceptable diffusion zone cannot be obtained. If necessary, a reinforcing adhesive layer, or other impervious layer, to the back, or rear, of the window and pad-matrix may, also, be provided, as explained above.

Referring to FIG. 5, there is shown a second embodiment. In this embodiment, the local section or area of the polishing pad is not initially voided or cut out, but rather the pad-material at the local section 13 is of lower or decreased density than that the rest of the pad-material matrix. When the flowing polymer is injected into the local area, the voids in the lower-density material thereat are filled with the polymer, thereby providing a section sufficiently transparent to the end point laser. In this embodiment, the pad-material forming the low-density area is preferably the same material as the rest of the porous pad itself. However, the density thereof is lower, such as, for example, less than 1 g/cm^3. It is, of course, to be understood that the above-described specifications are not limiting, with the present invention-encompassing a large range, as would be evident to one of ordinary skill in the art. For example, the density of the window-region may vary depending on the material and polymer used, opaqueness, laser-frequency used, and the like.

Referring to FIG. 6, there is shown a third embodiment of the invention. In this embodiment, a distinct and separate transparent window-plug 22 is molded separately independently of the pad 20, and inserted into the cutout or opening of the pad. An impervious layer 24, which is preferably a polymer adhesive film, or other film, is attached to the back side or rear of the pad with heat, or applied in an uncured liquid state and allowed to cure. The impervious layer 24 is preferably a polyurethane adhesive film which is aligned with the previously-inserted window-plug 22, and which has a rectangular opening section 22' that is smaller in cross section than the window-plug 22 proper, in order to provide an overlapping section with respect to the window-plug 22. Heat and pressure are then applied, whereupon the polyurethane-film flows into the pad itself, and also bonds with the window-plug 22 via the overlapping section thereat, as seen in FIG. 6. After the polymeric: film has cured or cooled, a sealed boundary is created around a juxtapositioned portion of the transparent window-plug, as clearly shown in FIG. 6. A bottom adhesive layer 32 for securing the pad to a platen is then applied to the pad, and a small rectangular opening is also formed for alignment with the opening 22' of the impervious layer 24. The impervious layer 24 prevents infiltration into, and contamination of, the adhesive layer 32 by CMP slurry and other CMP-process chemicals during the CMP process. This prevents adhesive degradation and potential failure of the bond between the pad and platen. The impervious layer 24 is an adhesive film about 3 mil. thick, having a shore A hardness of 86, flowing at about 200 degrees F., and is heated to 300 degrees F. during, the above-described process.

While the above-description has been given with regard to: the formation of a window in a porous pad, and in particular to the porous paper-making-fiber-matrix polishing pads disclosed U.S. patent application Ser. Nos. 10/087,223 and 10/349,201, other types of porous pads or non-porous pads may also be provided with the window of the present invention. Formation of the window of the invention in a nonporous pad is similar to first embodiment described above for a porous pad, where there is created a higher-density zone around the opening in the nonporous pad for the window, the diffusion zone thus being decreased or eliminated altogether at a high-density barrier, as described above. Further structural integrity may be achieved by attaching an adhesive layer, or other impervious layer, to the back of the window or nonporous pad, as described above. In this case, the additional layer must be of sufficient clarity to allow proper functioning of the end-point detection.

While specific embodiments of the invention have been shown and described, it is to be understood that numerous changes and modifications may be made therein without departing from the scope and spirit of the invention as set forth in the appended claims.

What is claimed is:

1. A polishing pad for use in chemical mechanical polishing of substrates, said polishing pad having a polishing surface, comprising:

a porous fibrous matrix;

a binder for binding said fibrous matrix;

said fibrous matrix forming a porous structure by which polishing slurry and polishing debris during chemical mechanical polishing of substrates are temporarily stored for subsequent rinsing away, and for enhanced flow-distribution of the polishing slurry;

said fibrous matrix comprising an end-point-detection transparent window section for allowing light beams from an end-point detection apparatus to pass therethrough wherein said fibrous matrix comprises a lower-density area, said lower-density area having a density less than at least part of the remainder of said fibrous matrix.

2. The polishing pad for use in chemical mechanical polishing of substrates according to claim 1, wherein said end-point-detection transparent window section comprising said lower-density area and laser-transparent polymer material interspersed in said lower-density area.

3. The polishing pad for use in chemical mechanical polishing of substrates according claim 2, wherein said at least part of the remainder of said fibrous matrix comprises a higher-density surrounding section immediately adjacent to, and encompassing, said lower-density area; said higher-density surrounding section controlling the degree of dispersion of said laser-transparent polymer material interspersed in said lower-density area into the remainder of said fibrous matrix exterior of said lower-density area.

4. The polishing pad for use in chemical mechanical polishing of substrates according claim 1, wherein said end-point-detection transparent window section comprises laser-transparent polymer material; said fibrous matrix comprising a surrounding section that immediately surrounds said end-point-detection transparent window section; said surrounding section comprising a diffusion zone; said laser-transparent polymer material being diffused in said diffusion zone of said surrounding section, whereby said window-section is bonded to said fibrous matrix.

5. The polishing pad for use in chemical mechanical polishing of substrates according claim 4, wherein said fibrous matrix comprises a front working surface for use in polishing and a back surface for mounting to a platen of a CMP apparatus; said end-point-detection transparent window section being made of laser-transparent polymer material; said end-point-detection transparent window section being stepped and having a larger cross-sectional area toward said back surface for increasing structural integrity.

6. The polishing pad for use in chemical mechanical polishing of substrates according claim 4, wherein said fibrous matrix comprises a front working surface for use in polishing and a back surface for mounting to a platen of a CMP apparatus; said polishing pad further comprising a reinforcing impervious layer attached to said back surface for providing additional structural integrity to said window section in said fibrous matrix; said reinforcing impervious layer having a cutout in alignment with said end-point-detection transparent window section for allowing the light beam from an end-point-detection device to pass therethrough, said reinforcing impervious layer being fused to said back surface.

7. The polishing pad for use in chemical mechanical polishing of substrates according claim 6, wherein reinforcing impervious layer is fused to said back surface by heating said reinforcing impervious layer to cause a fused bond with said back surface; said polishing pad further comprising an adhesive backing layer for attaching said fibrous matrix to a platen; said adhesive backing layer being attached to said reinforcing impervious layer; said reinforcing impervious layer being sandwiched between said window section and said adhesive backing layer; said reinforcing impervious layer preventing slurry from contacting said adhesive backing layer during the CMP polishing process; said adhesive backing layer also having a cutout in alignment with said cutout of said reinforcing impervious layer for allowing the light beam from an end-point-detection device to pass therethrough.

8. The polishing pad for use in chemical mechanical polishing of substrates according claim 1, wherein said end-point-detection transparent window section comprises a window-plug made of laser-transparent polymer material; said fibrous matrix having a cutout section in which said window-plug is received;

said fibrous matrix comprising a front working surface for use in polishing and a back surface for mounting to a platen of a CMP apparatus;

said polishing pad further comprising a reinforcing impervious layer attached to said back surface for providing structural integrity to said window-plug in said fibrous matrix; said reinforcing impervious layer having a cutout in alignment with said cutout section of said fibrous matrix for allowing the light beam from an end-point-detection device to pass therethrough; said cutout being of less cross-sectional area than the juxtapositioned portion of said window-plug thereat in order to form an overlapping section of said reinforcing impervious layer that overlaps said juxtapositioned portion of said window-plug;

said overlapping section of said reinforcing impervious layer being fused to said juxtapositioned portion of said window-plug for bonding said reinforcing impervious layer to said juxtapositioned portion of said window-plug;

said reinforcing impervious layer also being fused to said back surface of said fibrous matrix.

9. The polishing pad for use in chemical mechanical polishing of substrates according claim 8, wherein said polishing pad further comprises an adhesive backing layer for attaching said fibrous matrix to a platen; said adhesive backing layer being attached to said reinforcing impervious layer; said reinforcing impervious layer being sandwiched between said window-plug and said adhesive backing layer; said reinforcing impervious layer preventing slurry from contacting said adhesive backing layer during the CMP polishing process; said adhesive backing layer also having a cutout in alignment with said cutout of said reinforcing impervious layer for allowing the light beam from an end-point-detection device to pass therethrough.

* * * * *